US006594956B1

(12) United States Patent
Willing

(10) Patent No.: US 6,594,956 B1
(45) Date of Patent: Jul. 22, 2003

(54) ATTACHMENT DEVICE FOR LEAF-DEFLECTION TUBES

(76) Inventor: Hubertus Willing, Bergstrasse 28, 48727 Billerbeck (DE)

( * ) Notice: Subject to any disclaimer, the term of this patent is extended or adjusted under 35 U.S.C. 154(b) by 0 days.

(21) Appl. No.: 09/830,917

(22) PCT Filed: Sep. 26, 2000

(86) PCT No.: PCT/DE00/03381

§ 371 (c)(1),
(2), (4) Date: Jul. 30, 2001

(87) PCT Pub. No.: WO01/25565

PCT Pub. Date: Apr. 12, 2001

(30) Foreign Application Priority Data

Oct. 2, 1999 (DE) ..... 199 47 531
Oct. 20, 1999 (DE) ..... 199 50 472

(51) Int. Cl.[7] ..... E04D 13/00
(52) U.S. Cl. ..... 52/11; 248/48.2
(58) Field of Search ..... 248/48.1, 48.2; 52/11, 12

(56) References Cited

U.S. PATENT DOCUMENTS 669,495 A * 3/1901 Babcock
706,333 A * 8/1902 Meuser
3,023,544 A * 3/1962 Hughes
3,367,020 A * 2/1968 Mitchell
4,455,791 A 6/1984 Elko et al. ..... 52/12
5,040,750 A * 8/1991 Brant ..... 248/48.2
5,072,551 A * 12/1991 Manoogian ..... 52/12
5,398,464 A 3/1995 Jacobs ..... 52/12
5,617,678 A * 4/1997 Morandin et al. ..... 52/11
5,729,931 A * 3/1998 Wade ..... 52/12

FOREIGN PATENT DOCUMENTS

DE G 84 00 445.2 7/1984
DE 94 20 720 U * 3/1995
DE G 94 20 272.9 5/1995
DE 299 18452 U * 1/2000
GB 331 442 A * 7/1930

* cited by examiner

*Primary Examiner*—Robert W. Gibson, Jr.
(74) *Attorney, Agent, or Firm*—Lahive & Cockfield, LLP

(57) ABSTRACT

The invention provides an attachment device for a leaf-deflection tube insertable in gutters, which tube is provided with a plurality of drain openings in the tube wall, the attachment device having a retaining rod which may be passed through the drain openings of the leaf-deflection tube and the length of which is greater than the diameter of the leaf-deflection tube, and which has a first end surrounding the front edge of the gutter and a second end attachable to the roof structure.

5 Claims, 1 Drawing Sheet

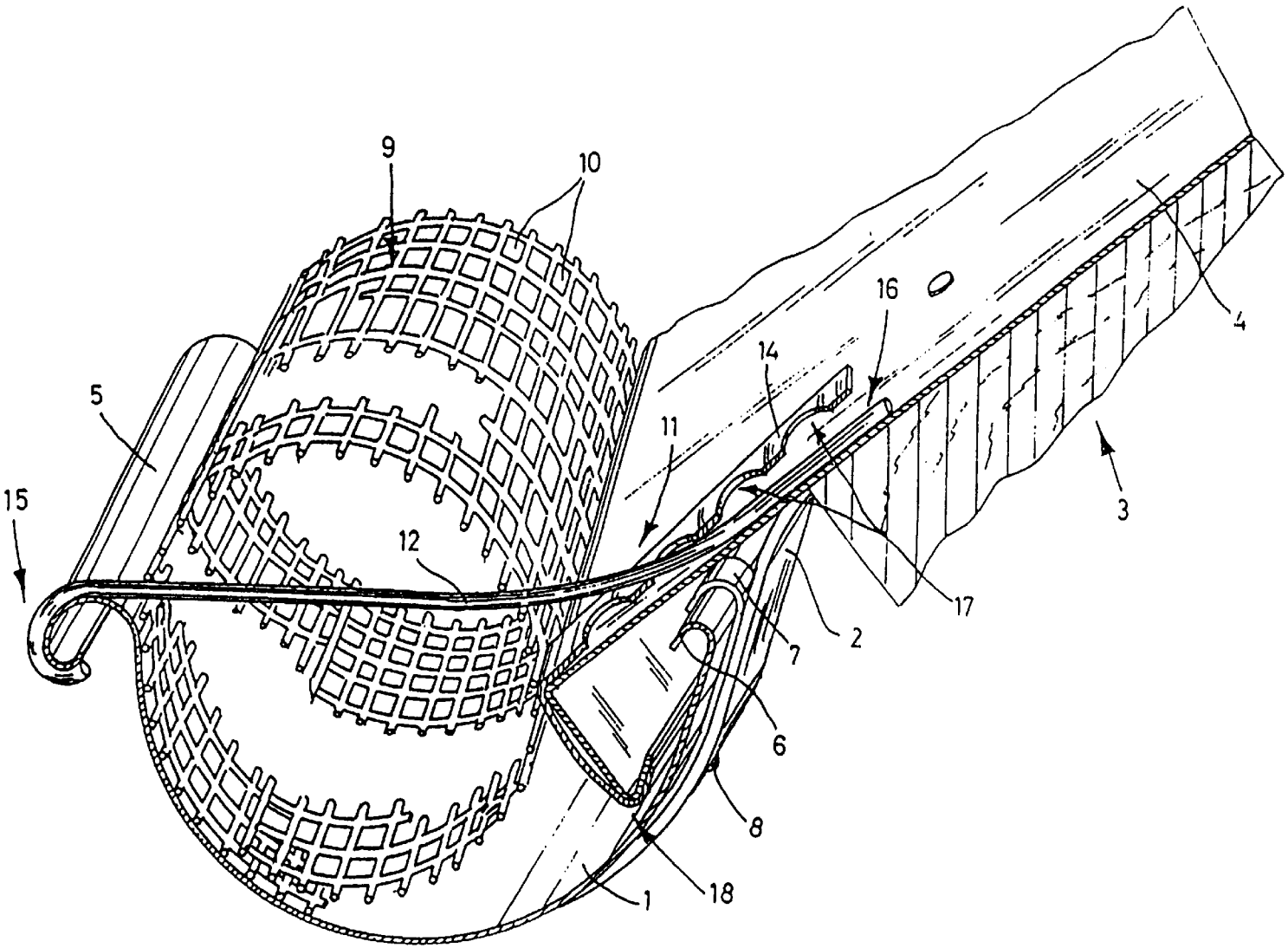
4
3
17
16
2
7
6
8
18
14
11
1
10
12
9
5
15

ATTACHMENT DEVICE FOR LEAF-DEFLECTION TUBES

BACKGROUND OF INVENTION

The invention relates to an attachment device for leaf-deflection tubes.

Practical applications of such leaf-deflection tubes are well known. They may, for example, be designed as screen tubes which are segmented in a longitudinal direction and installed under tension in gutters of various diameters. In theory, the prestressing of the screen tube sufficiently secures the leaf-deflection tube in the gutter.

Practical use has shown, however, that as a result of material fatigue the prestress inherent in the tube weakens over time such that its securing ability is no longer ensured. The leaf-deflection tube may then move out of the gutter, thus permitting leaves to enter and block the gutter, in which case the leaf-deflection tube becomes counterproductive since the tendency of the wind to dry and remove leaves in the gutter is thwarted, as these leaves are now held by the leaf-deflection tube.

The process of installing the leaf-deflection tubes may also entail difficulties: leaf-deflection tubes are provided in standard lengths, e.g. 3 meters. When they are installed in the gutter, the leaf-deflection tubes are usually arranged to abut each other. Because of this, when the subsequently mounted end of the leaf-deflection tube is pressed in, the opposite, initially-mounted end of the leaf-deflection tube is levered out of the gutter. When the user is working at the one end, the other end of the same leaf-deflection tube, often 3 m distant, is no longer accessible, with the result that the ladder or other working platform must be repositioned in order to remount this first end of the leaf-deflection tube which has lifted itself out. The result is that mounting becomes both complex and costly.

DE 84 00 445 U1 discloses an attachment device for a leaf-deflection tube which surrounds both the leaf-deflection tube and the gutter. The attachment means provided over the leaf-deflection tube creates gaps between the attachment means and the leaf-deflection tube as well as wedge-shaped cavities between the attachment means, leaf-deflection tube and gutter so that, under unfavorable circumstances, leaves may become caught in these gaps and cavities, and cannot be blown free by the wind even after drying out.

DE 94 20 720 U1 discloses a leaf-deflection tube created by rolling up a flat material, a border flange of this flat material being made to protrude beyond the closed circular cross section of the leaf-deflection tube. This border flange may be inserted under the roof structure and effect the secure positioning of the leaf-deflection tube. No additional attachment means are provided.

DE 94 20 272 U1 discloses a flat leaf-deflection screen which is placed over the gutter. This flat screen strip is retained by retaining rods which are slotted and which surround the screen strip both on the top and bottom. Here too, it is possible for gaps to form on the top of the leaf-deflection cover between the attachment means and the screen strip—with the result that is possible for leaves to become caught in these gaps.

U.S. Pat. No. 4,455,791 also discloses a leaf-deflection cover consisting of a flat sheet-type material which may be bent tube-fashion only in the area of one of its longitudinal edges while otherwise providing a flat cover extending over the gutter. Here again there are attachment components in the form of retaining rods above the actual leaf-deflection cover, again with the result that the risk of leaves becoming caught in the gaps cannot be ruled out.

U.S. Pat. No. 5,398,464 also discloses a flat, plane cover for gutters which is supported by retaining rods. The retaining rods do not surround the front edge of the gutter but are inserted into a protrusion in the front edge of the gutter and are curled and folded multiple times so as to be held in the gutter and also to secure the front edge of the leaf-deflection screen. This multiply folded region of the retaining rod must be fixed in its folded position by a rivet, screw, or the like, and secure the leaf-deflection screen with the aid of this rivet, screw or the like, and also secure the retaining rod to the gutter which itself is penetrated by the rivet, screw or the like. The process of mounting using such attachment means is complex and requires partial destruction of the gutter resulting from the provision through the gutter of the matching holes needed to accommodate the attachment means, such as rivets, screws and the like.

SUMMARY OF THE INVENTION

The object of the invention is to create an attachment device for leaf-deflection tubes which simplifies the mounting of leaf-deflection tubes, which permits the mounting of leaf-deflection tubes of fully or partially circular cross section, and which ensures lasting and secure retention of the leaf-deflection tubes in their intended mounting position.

This goal is achieved by the attachment device having drain openings and a retaining rod according to the teaching of the present invention.

The invention proposes, in other words, using retaining rods which extend transversely through the leaf-deflection tube. These retaining rods, having been appropriately bent or angled at one end, surround the front edge of the gutter and thus ensure reliable protection against lifting forces. In addition, these retaining rods have a second end which is attachable to the roof structure. There are multiple variations depending on the roof design.

If the retaining rod is passed through the drain openings of the leaf-deflection tube, not only is any pressure acting from above on the leaf-deflection tube precluded but the leaf-deflection tube is secured both against upwardly and downwardly acting forces. A leaf-deflection tube with a not-fully-circular cross section is thus securely held in its prescribed mounting position and is not forced down into the gutter.

Such leaf-deflection tubes of partially circular cross section may be desirable and not only for reasons of low material cost:

Just as with traditionally known leaf-deflection tubes of circular cross section, the convex upwardly arched arrangement of these gutter covers advantageously permits leaves on this cover to be dried out and blown off by the wind.

Compared with the known type of leaf-deflection tube with a completely circular cross section, an advantageous effect is that the inner cross section of the gutter remains completely unobstructed so that very fine dirt penetrating the openings of the leaf-deflection tube is not retained by the gutter, which would eventually result in gradual blockage of the gutter.

In the context of the present invention, the term "leaf-deflection tube" refers explicitly not only to the known leaf-deflection tubes with closed circular cross sections but also to strips of screen or perforated sheet material or the like when these strips are mounted in the gutter to form a convex upward arch.

An especially simple provision may be to pass the second end under the roof covering, for example under the roof tiles which due to their inherent weight are able to reliably secure the covering against lifting forces.

Attachment of the already mounted sections of a leaf-deflection tube eliminates any need to subsequently readjust the already mounted section after mounting an additional section of the same leaf-deflection tube. The leaf-proof joining of two adjacent leaf-deflection tubes is also ensured by this approach. Despite the higher utilization of materials and the time requirement for attaching the leaf-deflection tubes, the result for the industrial user is a savings of time and costs, initially during the mounting process and subsequently as a result of fewer complaints.

Another feature may be provided in which the retaining rods are designed in a different shape, e.g. bent, so that the second end is angled upward as compared with the rest of the retaining rod so as to facilitate easy insertion of the second end into the roof structure, for example under the roof tiles. It may be advantageous, however, to design the retaining rods to be elastically deformable so that the retaining rod may be optimally and simply adapted to any given roof design irrespective of the design of the roof.

An especially advantageous provision may be to use a special retaining brace which is attachable to the roof structure and to which the second end of the retaining rod may be attached. Such retaining braces may be designed, for example, as wire braces with a lug through which the second end of the retaining rod may be passed.

An especially simple and inexpensive design of the retaining brace is in the form of a commercially available perforated strap, i.e. a strap provided with a continuous set of holes. This design allows for inexpensive manufacture of the retaining brace as the perforated strap is simply divided into the desired lengths, each representing one retaining brace. For the user, the plurality of holes additionally facilitates the especially simple mounting of the retaining rod since, regardless of varying conditions in terms of mounting, gutter design and roof design, a suitable hole in the perforated strap may always be located by which to reliably attach the second end of the retaining rod.

The retaining brace may be advantageously made of metal or have a metal reinforcement which allows the retaining brace to be packaged cheaply and in a flat, space-saving manner, and to be bent or angled to fit the existing mounting situation and thus secured on the roof structure. The metal ensures the reliable dimensional stability of the shaped retaining brace, and thus reliable and lasting retention of the retaining brace rod. No additional attachment means such as nails, screws, or the like are required, with the result that easy attachment of the retaining brace is possible, specifically to the gutter or to the locations on the roof structure where otherwise the aforementioned additional attachment means would have the undesirable effect of degrading the sealing function.

BRIEF DESCRIPTION OF THE DRAWINGS

The FIGURE is a schematic view of the attachment device of the present invention.

DESCRIPTION OF ILLUSTRATED EMBODIMENT

Reference numeral 1 is a gutter which is secured by hook 2 to a roof structure designated overall as 3. Roof structure 3 has a folded front edge 5 as well as a rear edge 6, folded inward, which is secured by a strap 7 which in turn is attached by a rivet 8 to hook 2.

Inserted into gutter 1 is a leaf-deflection tube 9 which consists of a plastic screen tube segmented longitudinally and therefore having a plurality of drain openings 10 which allow unobstructed entrance of rainwater into gutter 1. Leaves, on the other hand, are retained due to the screen mesh size of leaf-deflection tube 9.

The leaf-deflection tube 9 is securely held in gutter 1 by an attachment device 11 which consists of a retaining rod 12 and a retaining brace 14. Retaining rod 12 consists of a metal rod with its first end 15 folded back to surround the front edge 5 of gutter 1, thus securing retaining rod 12, and thus leaf-deflection tube 9, against lifting forces.

A second end 16 of the retaining rod 12 abuts the flashing 4. The second end 16 of the retaining rod 12 passes here through one of the many openings 17 in the retaining brace 14, the retaining brace 14 being made of a high-grade steel. The retaining brace 14 is guided around bends in the lower end of the flashing 4 and has a lower end 18 bent in a hooked shape by which the retaining brace 14 surrounds the flashing 4 such that the retaining brace 14 is also secured against lifting forces.

The plurality of drain openings 10 and openings 17 allow the user to determine the required routing of the retaining rod 12 through the leaf-deflection tube 9. In the embodiment shown, the retaining rod 12 is elastically deformed so that it is mounted under tension. This ensures an especially secure and wobble-free attachment of the leaf-deflection tube to the gutter 1.

Depending on the roof cover selected, provision may be made to guide the second end 16 of the retaining rod 12 and the upper end of the retaining brace 14 under the roof cover, for example under the first row of roof tiles, thus creating an arrangement of the attachment device 11 which is as visually unobtrusive as possible and at the same time weather-proof. The attachment device 11 preferably consists, however, of weather-proof materials such as high-grade steel.

In the embodiment described, the leaf-deflection tube 9 is slotted to allow a certain overlap when adapting it to the installation situation. As a whole, however, the leaf-deflection tube 9 forms a closed circular cross section. In the embodiment described, essentially the same retention of a leaf-deflection tube is also possible for gutter covers in which the so-called "leaf-deflection tube" does not, unlike the leaf-deflection tube 9 shown, form this type of closed circular cross section but rather a semicircle, a third of a circle, or simply a shape bent convexly upward; it should be noted that such gutter covers which are similarly designated as "leaf-deflection tubes" extend into the gutters only so far as necessary to be secured by the attachment device.

What is claimed is:

1. Attachment device for a leaf-deflection tube insertable in a gutter, said leaf-deflection tube having a plurality of drain openings in a tube wall, the attachment device comprising a retaining rod which may pass through the drain openings of the leaf-deflection tube, and the length of which is greater than the diameter of the leaf-deflection tube, said rod having a first end surrounding the front edge of the gutter, and a second end attachable to a roof structure, and a retaining brace attachable to the roof structure and having one of an opening, a lug, and a projection to which the second end of the retaining rod is contiguously attachable.

2. Attachment device according to claim 1, wherein the second end of the rod is inserted under a roof cover.

3. Attachment device according to claim 1, wherein the retaining rod is elastically deformable to be mounted under tension.

4. Attachment device according to claim 1, wherein the retaining brace is designed as a perforated strap which has a plurality of openings running sequentially the length of the perforated strap.

5. Attachment device according to claim 1, wherein the retaining brace is made of metal or contains a metal reinforcement.

* * * * *